US008839556B2

(12) United States Patent
Brooks et al.

(10) Patent No.: US 8,839,556 B2
(45) Date of Patent: Sep. 23, 2014

(54) PET DOOR SYSTEMS AND METHODS OF OPERATION THEREOF

(71) Applicants: Steve Martin Brooks, Pyrford (GB); David Alan Woodfield, Walsall (GB); Andrew Keatley, Wolverhampton (GB)

(72) Inventors: Steve Martin Brooks, Pyrford (GB); David Alan Woodfield, Walsall (GB); Andrew Keatley, Wolverhampton (GB)

(73) Assignee: Pet Mate Ltd., Hersham (GB)

( * ) Notice: Subject to any disclaimer, the term of this patent is extended or adjusted under 35 U.S.C. 154(b) by 0 days.

(21) Appl. No.: 13/733,500

(22) Filed: Jan. 3, 2013

(65) Prior Publication Data

US 2013/0174618 A1 Jul. 11, 2013

(30) Foreign Application Priority Data

Jan. 10, 2012 (GB) ..... 1200312.5

(51) Int. Cl.

| | |
|---|---|
| ***E06B 7/32*** | (2006.01) |
| ***G07C 9/00*** | (2006.01) |
| ***E05B 65/06*** | (2006.01) |
| *E05B 47/00* | (2006.01) |

(52) U.S. Cl.

CPC . *E06B 7/32* (2013.01); *E05B 65/06* (2013.01); *E05B 2047/0094* (2013.01); *G07C 9/00896* (2013.01); *G07C 9/00309* (2013.01); *G07C 9/00111* (2013.01)

USPC ..... 49/163

(58) Field of Classification Search

USPC ..... 119/501

See application file for complete search history.

(56) References Cited

U.S. PATENT DOCUMENTS

| | | | | |
|---|---|---|---|---|
| 6,072,402 | A * | 6/2000 | Kniffin et al. | 340/5.28 |
| 7,395,782 | B1 * | 7/2008 | Lindsay | 119/51.02 |
| 7,458,336 | B2 * | 12/2008 | Eu | 119/51.02 |
| 7,511,626 | B2 * | 3/2009 | Siegmann et al. | 340/573.3 |
| 7,583,931 | B2 * | 9/2009 | Eu | 455/41.2 |
| 7,765,955 | B2 * | 8/2010 | Brooks et al. | 119/484 |
| 8,232,860 | B2 * | 7/2012 | Goel | 340/5.2 |
| 8,240,085 | B2 * | 8/2012 | Hill | 49/169 |

(Continued)

FOREIGN PATENT DOCUMENTS

| | | |
|---|---|---|
| EP | 0615136 | 12/1993 |
| GB | 2305211 | 2/1997 |

(Continued)

OTHER PUBLICATIONS

Great Britain Search Report, Application No. GB1200312.5, May 4, 2012.

*Primary Examiner* — Katherine Mitchell
*Assistant Examiner* — Justin Rephann
(74) *Attorney, Agent, or Firm* — Fay Sharpe LLP

(57) ABSTRACT

A method of operation of a pet door system with a controllable lock and circuitry including a resonant circuit having an antenna and an element to vary the resonant frequency of the circuit according to a setting parameter, a drive circuit for driving the resonant circuit with a drive signal, and a demodulator, the method including a setting-up operation comprising varying the setting parameter while driving the resonant circuit at a first driving frequency, detecting a first value of the setting parameter at which the resonant circuit is substantially in tune while the resonant circuit is driven at the first driving frequency, and storing the first value of the setting parameter. The method further includes a reading operation comprising reading the first value, driving the resonant circuit at the first driving frequency with the setting parameter set to the first value, and attempting to derive data from the demodulator.

16 Claims, 4 Drawing Sheets

(56) References Cited

U.S. PATENT DOCUMENTS

| | | | | |
|---|---|---|---|---|
| 8,286,591 | B2 * | 10/2012 | Moffett-Chaney et al. | 119/501 |
| 8,539,715 | B2 * | 9/2013 | Hill | 49/169 |
| 2004/0100386 | A1 * | 5/2004 | Tendler | 340/573.3 |
| 2005/0274463 | A1 * | 12/2005 | Becker | 160/98 |
| 2007/0130833 | A1 * | 6/2007 | Maital | 49/31 |
| 2007/0234643 | A1 * | 10/2007 | Siegal et al. | 49/360 |
| 2010/0242854 | A1 * | 9/2010 | Seger et al. | 119/484 |
| 2010/0293861 | A1 * | 11/2010 | Ting et al. | 49/394 |
| 2011/0001606 | A1 * | 1/2011 | Charych | 340/5.7 |
| 2011/0102149 | A1 * | 5/2011 | Lin et al. | 340/10.1 |
| 2011/0192356 | A1 * | 8/2011 | Loosveld et al. | 119/840 |

FOREIGN PATENT DOCUMENTS

| | | |
|---|---|---|
| GB | 2381180 | 4/2003 |
| GB | 2430331 | 3/2007 |
| GB | 2432999 | 6/2007 |
| GB | 2447924 | 1/2008 |
| WO | WO97/45807 | 12/1997 |
| WO | WO2007/068974 | 6/2007 |
| WO | WO2008/041016 | 4/2008 |
| WO | WO2008/110833 | 9/2008 |
| WO | WO2008/142436 | 11/2008 |
| WO | WO2009/090426 | 7/2009 |
| WO | WO2010/055321 | 5/2010 |

* cited by examiner

PET DOOR SYSTEMS AND METHODS OF OPERATION THEREOF

CROSS REFERENCE TO RELATED APPLICATIONS

This application claims priority to and the benefit of GB Patent Application No. GB1200312.5 filed on Jan. 10, 2012, entitled PET DOOR SYSTEMS AND METHODS OF OPERATION THEREOF, the entireties of which applications are hereby incorporated by reference.

BACKGROUND

This invention relates to a pet door system and to a method of operation thereof.

Many owners of pets such as cats and dogs fit a pet door (usual referred to as a cat flap or a dog door) to their houses so that their pet(s) can leave and re-enter the house at will. As explained in patent document GB 1426698 (Pedrick), a problem with a simple cat flap is that other unwanted animals can also enter the house, and that earlier patent document proposed a chromatically-selective locking system for a cat flap. Of course, that earlier system is ineffective against unwanted animals having the same color fur as the "authorized" pet. Another known type of system has a magnetically-actuated locking mechanism which responds to a magnet attached to the collar of the authorized pet. Of course, such a system is ineffective against unwanted pets whose owners have fitted similar pet door systems to their houses and attached similar magnets to their pets' collars. More recently, locking systems have been used which employ a radio frequency identification RFID device carried by the pet. The RFID device can respond to an RFID reader fitted adjacent the pet door and transmit a unique ID to the reader. The system can then compare the received ID with one or more authorized IDs and unlock the pet door only if there is a match.

In a typical inductively-coupled passive RFID system, the RFID reader includes an RLC resonant circuit including a coil antenna as its inductor. The reader's resonant circuit is driven at a driving frequency, and the antenna radiates energy. A resonant circuit in an RFID device adjacent the reader receives some of the radiated energy and uses the received energy to power the RFID device. When powered up, the RFID device modulates the loading that it places on the reader's resonant circuit typically with a repeating message each consisting of a stream of binary bits which include the unique ID of the RFID device. The reader demodulates the antenna signal and decodes the message. Therefore when used in a pet door system, if the ID in the decoded message matches the authorized ID, or one of the authorized IDs, registered in the system, the pet door is unlocked.

In order to maximize the energy radiated by the RFID reader, the driving frequency at which the reader's resonant circuit is driven should be equal to the resonant frequency of the reader's resonant circuit. Also, in order to maximize coupling between the RFID reader and device thus maximize message quality, the driving frequency of the reader and the resonant frequency of the RFID device's resonant circuit should be equal.

In the case where a pet door system with an RFID reader is supplied with a single RFID device, for example for attachment to the pet's collar, the driving frequency of the reader and the resonant frequency of the reader can be set at the factory to match the resonant frequency of the RFID device. However, even so, once the pet door system is installed, the driving frequency, and in particular the resonant frequency, may then drift over time. For example, the following can each have a significant effect on the driving frequency and/or resonant frequency of the reader: (a) the type of house door or wall to which the pet door is fitted, (b) siting a large household appliance such as a washing machine near the pet door, (c) temperature, (d) aging of components and (e) power supply voltage.

In the case where a pet has been 'microchipped' with an implanted RFID device, it would be desirable for a pet door system to be able to communicate with the implanted RFID device, rather than requiring a separate RFID device attached to the pet's collar. However, different types of microchips with different nominal resonant frequencies are used for implanting into pets. Although an RFID device reader driven at one frequency can in some circumstances communicate with an RFID device having a different resonant frequency, the data quality is often poor, and repeated reading may be required in order to obtain a complete, error-free message.

The signal strength of the demodulated signal in an RFID reader is dependent on the distance between the reader and the device, and the amount of loading modulation provided by the RFID device. Different types of pet microchips provide different amounts of loading modulation. However, the amplitude of the signal to be decoded is preferably approximately constant. It is possible to provide an amplifier/attenuator between the demodulator and the decoder which provides some form of automatic gain control. However, this adds to the circuit complexity and manufacturing cost and desirably would be avoided.

Aims of the present invention, or at least of specific embodiments of it, are to provide an RFID pet door system and to a method of operation thereof which does not require the RFID reader to be tuned at the factory, which can cope with tuning drift, which can be used with different types of RFID device having different resonant frequencies, and which does not require any automatic gain control amplifier or attenuator between the demodulator and downstream circuitry.

BRIEF DESCRIPTION

In accordance with a first aspect of the present invention, there is provided a method of operation of a pet door system comprising a pet door, a controllable lock for locking and unlocking the door, a resonant circuit having an antenna and having a element controllable in accordance with a setting parameter to vary the resonant frequency of the circuit, a drive circuit for driving the resonant circuit with a drive signal at a driving frequency so that the antenna can communicate with an RFID device carried by a pet and so that the RFID device can modulate a signal in the resonant circuit with RFID device data, and a demodulator for demodulating the modulated signal in the resonant circuit to produce a demodulated signal and for deriving the data from the demodulated signal. The method of the first aspect of the invention comprises the steps of performing a setting-up operation and then subsequently performing a reading operation. The setting-up operation comprises the steps of: varying the value of the setting parameter of the controllable element while driving the resonant circuit at a first driving frequency, detecting a first value of the setting parameter at which the resonant circuit is substantially in tune while the resonant circuit is driven at the first driving frequency, and storing the first value of the setting parameter. The subsequent reading operation comprising the steps of: reading the stored first value of the setting parameter, driving the resonant circuit at the first driving frequency with the setting parameter of the controllable element set to the read first value of the setting parameter, and attempting to derive data from the demodulator.

The pet door system can therefore ascertain and store a value of the setting parameter of the controllable element at which the resonant circuit is driven substantially at resonance so as to maximize the energy radiated by the antenna, and it can then use that stored value to set the resonant circuit during a subsequent reading operation.

Such a setting-up operation may take a longer period of time to perform than a reading operation, but preferably such a setting-up operation is not performed each time a reading operation is performed. Otherwise, the system may have insufficient time to unlock the door to an authorized pet, and the pet may, for example, bang its nose on the still-locked door.

In the case where, after each reading operation, a further such reading operation is performed automatically, such a setting up operation is preferably not performed automatically between every successive pair of reading operations. Reading operations can therefore be performed at a faster rate. Alternatively, in the case where the method includes the steps of detecting proximity of a pet to the door and, in response to such detection, performing such a reading operation, the method preferably does not include the step of performing such a setting-up operation in response to such detection. There is therefore no delay for a setting-up operation between a proximity detection and a reading operation, nor any delay between one reading operation and the next in the event that the pet does not go through the door when it is first unlocked.

Such a setting-up operation is preferably performed in response to powering-up of the system. Therefore, once the system has been installed, an initial value of the setting parameter of the controllable element at which the resonant circuit is driven substantially at resonance, taking into account the system's surroundings, can be ascertained and stored.

Such a setting-up operation is preferably performed at predetermined time intervals. The value of the setting parameter can therefore be updated to take account of aging of components, changes of season and changes to the system's surrounding.

The method preferably further includes the steps of performing a registration operation in which such a reading operation is performed and at least some of the derived data (such as the ID of the pet's RFID device) is stored. In this case, such a setting-up operation is preferably performed in conjunction with such a registration operation.

In the case where the system may be required also to communicate with a different RFID device having a different resonant frequency, the setting-up operation preferably also includes the steps of: varying the value of the setting parameter of the controllable element while driving the resonant circuit at a second driving frequency, detecting a second value of the setting parameter at which the resonant circuit is substantially in tune while the resonant circuit is driven at the second driving frequency, and storing the second value of the setting parameter.

In this case, the reading operation, after a first phase of the aforementioned steps, preferably further includes the steps, during a second phase of the reading operation, of reading the stored second value of the setting parameter, driving the resonant circuit at the second driving frequency with the setting parameter of the controllable element set to the read second value of the setting parameter, and attempting to derive data from the demodulator. Therefore, if data cannot be obtained during the first phase of the reading operation at the first frequency, for example because an RFID device in the vicinity of the system has the second frequency as its resonant frequency, an attempt will then be made to obtain the data at the second frequency.

The method may further comprise the step of determining, from the data derived during such a first phase of the reading operation, whether to make such a change to such a second phase of the reading operation. For example, if the system is attempting at the first frequency to read a RFID device having the second frequency as its resonant frequency, it is possible that the system may be able to read part of the message correctly. Typically an RFID device provides, at the beginning of its message, data identifying the type of RFID device. If this part of the message is successfully read, albeit not at the optimum frequency, it is possible to determine from the RFID type data, a nominal optimum frequency for reading that RFID device. If that frequency is equal to the second frequency of the system, the system can change to the second phase of the reading operation in an attempt to improve the chances of reading the whole of the message successfully.

The steps of attempting to derive RFID type data during such a first phase and such a second phase of the reading operation are preferably performed without interruption. Therefore if a first part of the message has been successfully read and the frequency is changed, the system continues attempting to read the remainder of the message without interruption, rather than discarding the remainder of the message and waiting to re-read the whole message at the second frequency.

Although only first and second driving frequencies have been mentioned above, it will be appreciated that the method may be extended to include three or more driving frequencies. Indeed the resonant circuit may be driven at any of the frequencies used for pet microchips, and a respective value of the setting parameter for the controllable element may be stored for each of the driving frequencies.

The method may further include the step, during such a reading operation, of detecting the signal strength of the demodulated signal, and adjusting the value of the setting parameter of the controllable element and/or the driving frequency in dependence upon the monitored signal strength.

For example, the value of the setting parameter of the controllable element and/or the driving frequency may be adjusted so as to maximize the detected signal strength. The system can therefore be fine tuned.

Alternatively, or additionally, the value of the setting parameter of the controllable element and/or the driving frequency may be adjusted so as to reduce the detected signal strength to a predetermined value. In other words, the system can be detuned to provide automatic gain control. In a system controlled by a microcontroller, this can be achieved by software, without requiring any additional hardware such as an adjustable gain amplifier/attenuator.

The resonant circuit preferably includes: an inductor, which forms the antenna, and a first capacitor permanently coupled into the resonant circuit; a second capacitor; and a switch for switchably coupling the second capacitor into the resonant circuit for a part of each cycle of the waveform of the drive signal, the switch and second capacitor forming the controllable element, and the part of each cycle being determined from the setting parameter.

In accordance with a second aspect of the present invention, there is provided a pet door system comprising: a pet door; a controllable lock for locking and unlocking the door; a resonant circuit having an antenna and having a element controllable in accordance with a setting parameter to vary the resonant frequency of the circuit; a drive circuit for driving the resonant circuit with a drive signal at a driving frequency so that the antenna can communicate with an RFID device carried by a pet and so that the RFID device can modulate a signal in the resonant circuit with data; a demodulator for demodulating the modulated signal in the resonant circuit to produce a demodulated signal and for deriving the data from the demodulated signal; and a controller for causing the system to operate in accordance with the method of the first aspect of the invention In accordance with a further aspect of the present invention, there is provided a method of operation of a pet door system comprising a pet door, a controllable lock for locking and unlocking the door, a resonant circuit having an antenna, a drive circuit for driving the resonant circuit with a drive signal at a driving frequency so that the antenna can communicate with an RFID device carried by a pet and so that the RFID device can modulate a signal in the resonant circuit with data, and a demodulator for demodulating the modulated signal in the resonant circuit to produce a demodulated signal and for deriving the data from the demodulated signal performing a reading operation including the steps of:

driving the resonant circuit at the first driving frequency, attempting to derive data from the demodulator, detecting if the antenna signal strength is too strong reducing the antenna signal strength.

It will be understood that the RFID device may be implemented by an RFID circuit mounted in or on a tag or fob, such as may be attached to a pet's collar, or alternatively the RFID may be a small circuit or chip injected or otherwise attached in or on the pet's body. The RFID device discussed here is of the passive type, but the principles discussed herein could be applied to battery powered RFID devices and active RFID devices.

Other aspects of the invention will become apparent from a reading and understanding of the detailed description of the embodiment described hereinbelow.

DETAILED DESCRIPTION

It should, of course, be understood that the description and drawings herein are merely illustrative and that various modifications and changes can be made in the structures disclosed without departing from the scope and spirit of the present invention. It will be appreciated that the various identified components of the pet door system and circuitry disclosed herein are merely terms of art that may vary from one manufacturer to another and should not be deemed to limit the present invention. Those of ordinary skill will also recognize that the pet door described herein can be used to identifying various tagged animals and control their entrance and exit in various environments.

Figure 1:
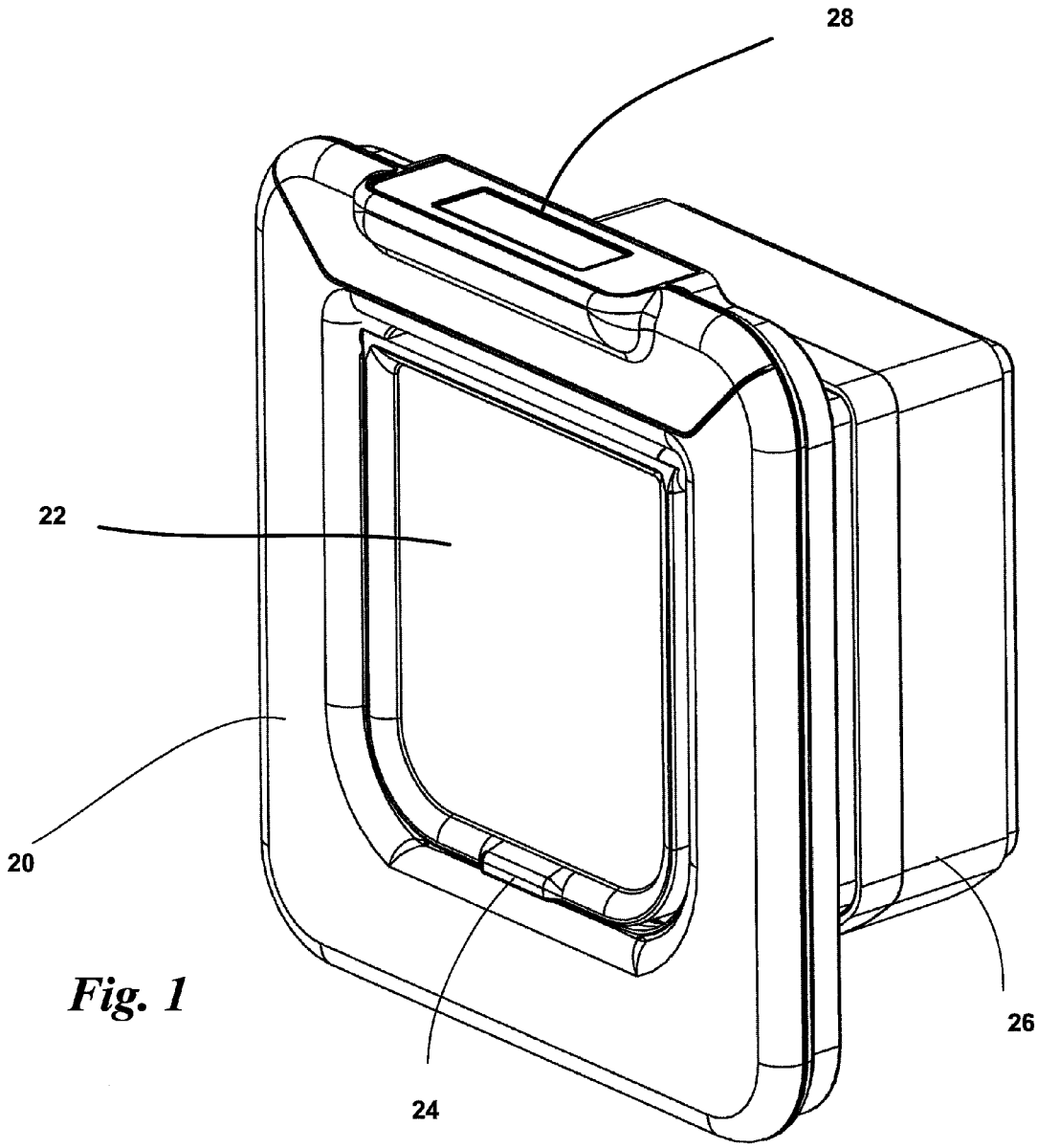
FIG. 1 shows a perspective view of a pet door.

The system is primarily intended for controlling the operation of pet door as shown in FIG. 1, comprising a frame 20 which holds a door 22 which can pivot open and shut. The opening of the door is controlled by a lock 24, the lock usually being an electromagnet motor, such that the door remains locked unless a cat with a particular recognized RFID device is detected in the immediate vicinity of the pet door. The RFID device is detected and interrogated by an aerial ideally situated in a tunnel portion 26 of the pet door, the aerial interfacing with circuitry contained in an electronics housing 28 situated here along the top surface of the pet door.

Figure 2:
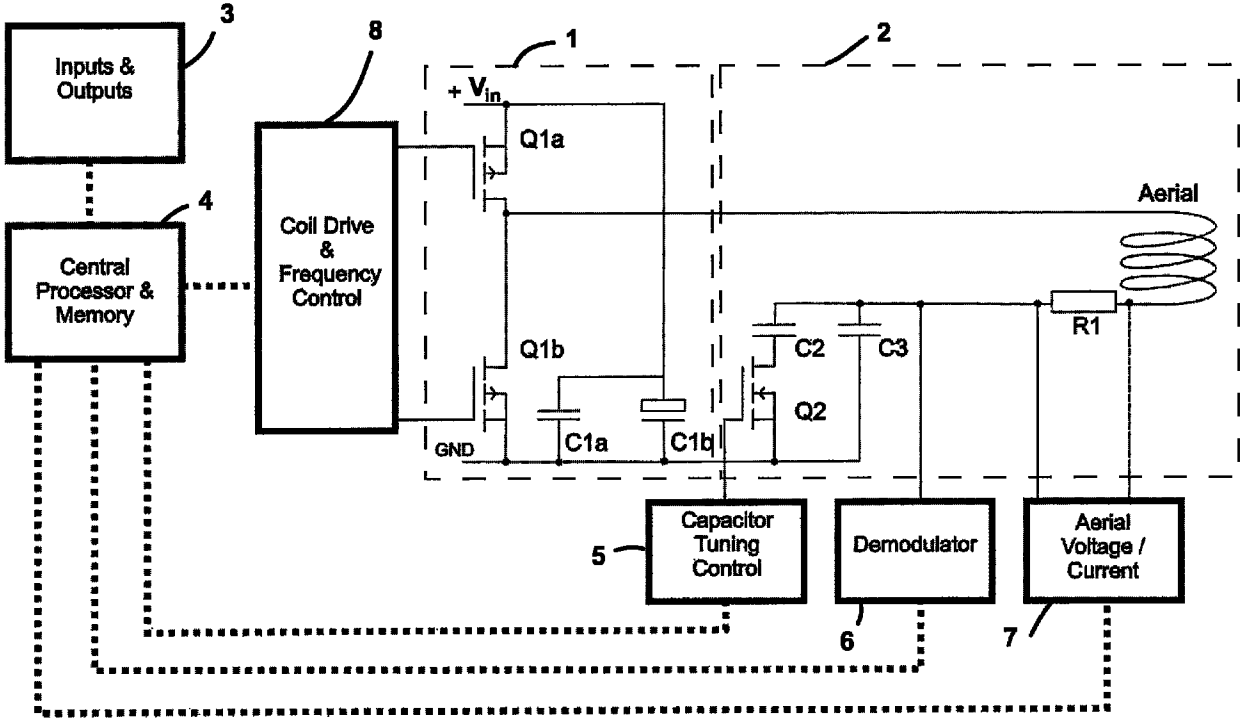
FIG. 2 shows a schematic diagram of the control circuitry.

Referring to FIG. 2, the sensor system is based on a pulse generator circuit 1, and a resonant circuit 2. Also shown are a central processing unit 3 which accepts inputs and generates outputs 4, the central processing unit 3 also controlling a capacitor tuning control unit 5, a demodulator 6, and an aerial voltage/current meter 7. The central processing unit 3 also controls the pulse generator circuit via a Coil Drive and Frequency Control unit 7.

The resonant circuit 2 comprises an aerial connected in series with a resistor R1, and a variable capacitor circuit comprising elements C2, C3 and Q2. C2 and C3 are connected to the resistor R1 in parallel, with C3 being directly connected to ground while C2 is connected via a FET Q2 which is controlled by the capacitor tuning control unit 5.

When the capacitor tuning control unit switches the Q2 on, C2 is connected in parallel with C3; when the Q2 is off however, C2 is isolated. The effective capacitance $C_{effective}$ provided by the variable capacitor circuit C2, C3 and Q2 is therefore $$C_{effective} = \frac{T_{on}}{T_{on} + T_{off}} C_2 + C_3 \tag{1}$$

The FET Q2 is cyclically switched on and off for time periods $T_{on}$ and $T_{off}$ respectively. Thus the variable capacitor circuit can provide any capacitance between $C_3$ and $C_2+C_3$ by varying the duty cycle of Q2.

The resonant circuit 2 therefore comprises an inductance L provided by the aerial, a resistor R1 (which may include a discrete component, but will also include inherent resistances from other components of the circuit), and a capacitance $C_{effective}$ which may be varied by the capacitor tuning control unit. The resonant frequency of the circuit is dependent on the inductance and the total capacitance according to a well known relationship; calculating the resonance using such an relationship however this depends on accurate knowledge of the capacitance and inductance. By contrast, the present method does not require the actual inductance or capacitances (which may include parasitic components contributed from nearby objects) necessarily to be known.

The pulse generator circuit comprises a FET pair, Q1*a*, Q1*b*, controlled by a coil drive and frequency control unit connected to the FETs' gates, and a parallel capacitor pair C1*a*, C1*b* connected to the common drain terminals of the FETs, the other side of the capacitor pair C1*a*, C1*b* being grounded. The common drain of the FET pair, Q1*a*, Q1*b* is connected to the aerial of the resonant circuit 2.

A positive voltage $V_{in}$ is applied to the source terminal of FET Q1*a*. The FET pair, Q1*a*, Q1*b* are then alternately stimulated, so that first FET Q1*a* outputs a signal, and then FET Q1*b* outputs a signal, producing a square wave with a maximum voltage of $V_{in}$. The any variance in voltage input $V_{in}$ is smoothed by the capacitor pair C1*a*, C1*b* and inductor aerial. This is discussed in more detail below.

In practice, a gap is introduced between the switching off of on FET and the switching on of the other FET, to ensure that there can be no shoot through current. This square wave stimulates the resonant circuit 2 where it is smoothed to a sinusoidal wave, and the aerial emits a radio signal at the square wave frequency.

Figure 3:
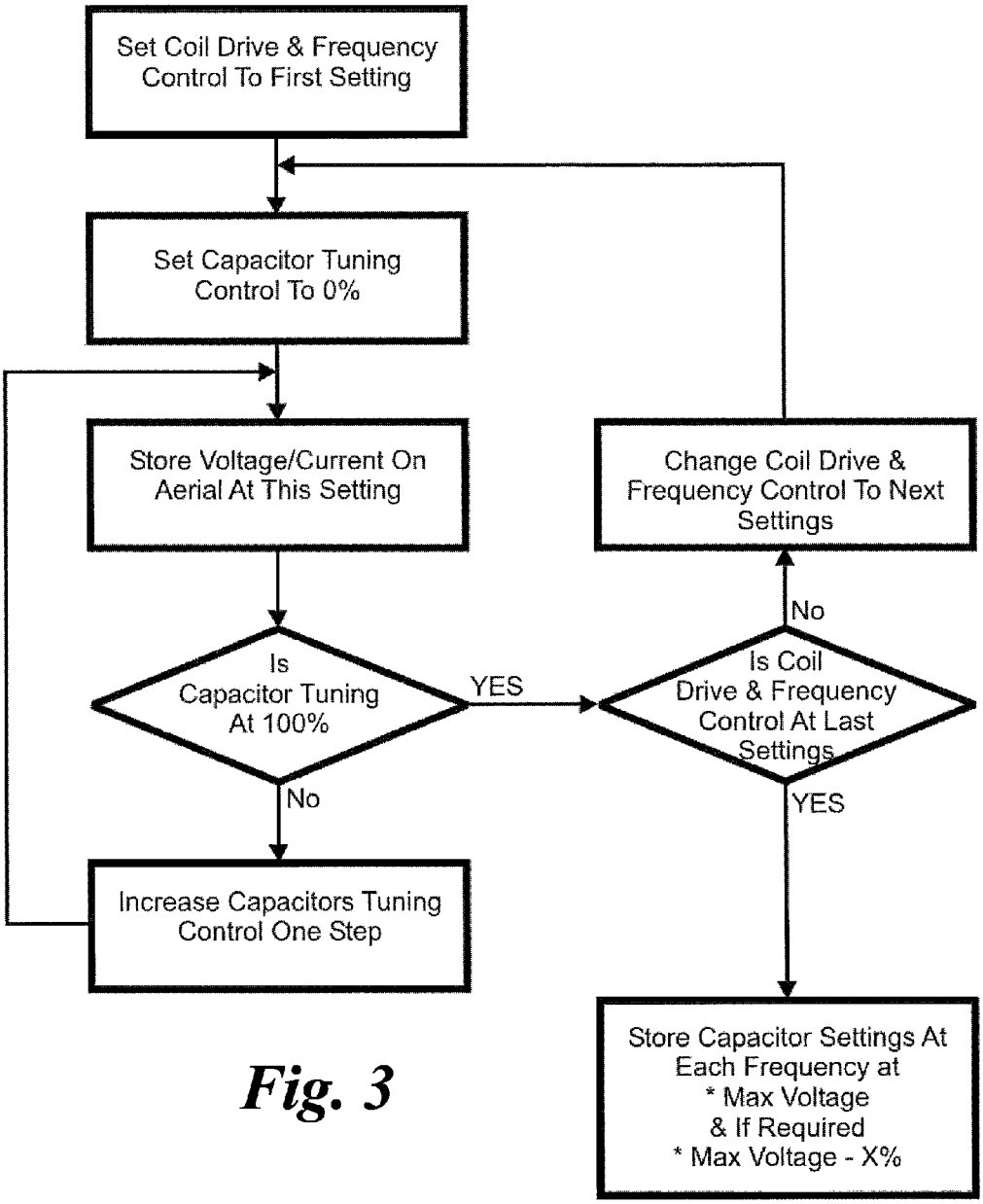
FIG. 3 shows a flow diagram showing the set-up procedure.

Referring to FIG. 3, the Coil drive and frequency control unit operates the FET pair Q1*a*, Q1*b* to produce a first frequency. The capacitor tuning control unit 5 is initially set so that the FET Q2 is off and $C_2$ is disconnected at one terminal, so that $C_{effective}$ is equal to $C_3$. The aerial voltage/current meter detects the voltage at a point in the circuit relative to ground; this is proportional to the voltage across the circuit resistance $R_1$. The measured voltage is also proportional to the current in the resonant circuit. The current (or the voltage) is stored together with the capacitor tuning control unit value.

The FET pair Q1*a*, Q1*b* continues driving the resonant circuit at the first frequency, while $C_{effective}$ is increased in discrete steps and the aerial voltage/current meter measures the voltage, the calculated current (or the voltage) being stored with the capacitor tuning control unit value until FET Q2 is permanently activated and $C_{effective}$ has reached its maximum value $C_2+C_3$. At this point the relationship between voltage (or current) and $C_{effective}$ between the values $C_3$ and $C_2+C_3$ is known for the first frequency. For a single frequency, running through the full range of $C_{effective}$ typically takes about 5 ms.

In general, there will be more than one frequency that the RFID reader must operate at, as different RFID device that are to be detected use different frequencies. If this is the case, the coil drive and frequency control unit is instructed to operate the FET pair to stimulate the resonant circuit 2 at the next frequency. The process of varying the duty cycle of $C_2$ to change $C_{effective}$ between the values of $C_3$ and $C_2+C_3$ in discrete steps, while recording the voltage in the resonant circuit 2, is repeated. This is repeated for each frequency that the resonant circuit will operate it when detecting and interrogating RFID device, so that the relationship between voltage and $C_{effective}$ between the values $C_3$ and $C_2+C_3$ is known for each of these frequencies.

To operate the aerial at peak efficiency, the frequency of the square wave input of the FET pair Q1*a*, Q1*b* should matched the resonant frequency of the resonant circuit 2. As previously discussed, the actual resonant frequency may vary depending on several factors, such as different values and tolerances of components, drift over time, and nearby objects and surroundings contributing stray capacitance and inductance. Therefore actual values of L and C will vary from circuit to circuit and over time.

The relationship between voltage and $C_{effective}$ at any particular frequency produced by the pulse generator circuit will include a maximum value where the actual resonance of the resonant circuit, including the various extraneous factors, matches that particular frequency. The $C_{effective}$ for this maximum voltage/current value is stored in the central processing and memory unit 3 for each frequency that the RFID reader is to detect and check.

Alternatively, $C_{effective}$ could varied through only part of its possible range, that is, the voltage/current value is measured while it increases, the subsequent decrease in the value indicating that the maxima has been reached, the $C_{effective}$ value can be stored and further readings for that pulse drive frequency are not required.

The process of determining the $C_{effective}$ for the voltage/current maxima at each frequency of interest is ideally carried out at a reasonable frequency, so that the RFID reader remains efficient with changes in conditions, such as aging and drift of components, changes in the surroundings, etc. The determination process may be initiated in response to the replacement of the pet door's batteries, by the programming of the pet door to accept a new RFID device (via an input/output unit), and after set times intervals such as every week. It may be carried out a more frequent intervals when the RFID reader is not busy, for instance immediately after an RFID devise search has been carried out without an RFID device being detected.

With a $C_{effective}$ value stored for each frequency of interest, the RFID reader can be can quickly and efficiently scan each frequency with the resonant circuit optimized in each case. If an RFID device operating at one of those frequencies is in the vicinity of the pet door, the signal from the aerial stimulates the RFID device circuit, causing it to produce a signal that is picked up by the aerial and decoded by the demodulator unit, so that the signal can be checked by the central processor and memory unit in the usual fashion.

It will be realized that the frequency of the resonant circuit may be varied using other permutations of capacitors to the parallel arrangement of C2 and C3 shown here, indeed inductors may also be varied to similar effect. In each case though, a parameter that be varied to vary the resonant frequency is provided, and the optimum value of that parameter is determined or stored. As will be described below, it may be advantageous to broadcast a signal using the resonant frequency circuit aerial at different strengths. Ideally then, the optimum $C_{effective}$ for the resonant circuit at different signal strengths is also ascertained (the signal strength being varied using different driving pulse amplitudes or pulse widths).

The setting up and the reading processes are thus essentially separate, and in general the reading process is more efficiently and quickly carried out if relying on stored parameters for optimizing the resonant circuit, than determining the parameters as part of the reading process, though this is also possible. The step of reading an RFID device may take up to 38 ms; typically, when search for an RFID device, a duration of 1.5 times the necessary time may be allocated i.e. 57 ms. When an RFID device is in proximity from the RFID reader aerial signal, and receives sufficient power to start modulating a signal back, the returned signal includes a header section identifying the particular type of RFID device.

A RFID reader may therefore be set up to scan for different RFID devices, which may employ two different frequencies. Further, the RFID reader may have a choice of two different signal strengths to broadcast each frequency on.

If the RFID reader stops broadcasting a signal, the RFID device immediately loses power and stops transmitting its own signal back. Therefore, if the interrogation of the RFID device is stopped in order to optimize the RFID reader's resonant circuit for the new frequency, the process must be restarted. Therefore, where the RFID is looking for two frequencies, using two possible signal strengths to find each frequency, the total search time may be four times the sum of the tuning time and the reading time; i.e. $4\times(5\text{ ms}+38\text{ ms}\times 1.5)=248$ ms to scan both frequencies at both signal strengths and read the RFID device. A cat may abandon an attempt to open a cat flap that takes longer than 500 ms to open, so the total reading time could take half of this total available time. The time taken to read and identify the RFID device would obvious increase proportionally if there are more possible frequencies and/or signal strengths to be employed.

The RFID reader can often receive this header even if it is broadcasting at an unsuitable frequency and power. Since the optimized settings are pre-stored, the RFID reader does not need to interrupt broadcasting power from the aerial to tune the circuit; all it needs to do is retrieve the stored parameter, and thereby adjust the frequency and power setting to one appropriate for that RFID device without interrupting power transfer to the RFID device. Since the RFID device is still receiving a signal, in fact now one both at the correct frequency and optimized for the surrounds and other variables previous discussed, it transmits its unique ID immediately. By using the stored parameter setting, there is no interruption of the interrogation and reading of the RFID device, and the RFID reader requires less than two reading periods 2×(38 ms×1.5)=114 ms to find the RFID device, identify the type, and extract the ID. This represents a considerable time saving within the window of 500 ms that is considered desirable to identify a cat.

As well as recording the $C_{effective}$ for the voltage maxima at each frequency of interest, the $C_{effective}$ for the voltage at a certain percentage, e.g. 50%, of the maxima may be recorded (there will be two $C_{effective}$ values either side of the peak that produce this voltage, if they fall within the range C2 to C2+C3). When $C_{effective}$ is set at this value, the frequency produced by the pulse generator circuit is not sustained as efficiently in the resonant circuit 2, so the strength of the signal from the aerial is reduced.

We have found that some RFID devices can malfunction, only giving a partial response to the RFID reader's interrogation, when the aerial signal strength is too strong, and further that the signal returned from the RFID device may be so strong as to overload the amplifiers in the demodulator 6. When the central processing unit 3 detects an incomplete signal from the demodulator 6, the capacitor tuning control unit 5 sets $C_{effective}$ to one of the stored values that correspond to 50%, of the maximum voltage, thereby reducing the strength of the aerial signal, and allowing the RFID device to generate a complete response without being over-stimulated.

Figure 4A:
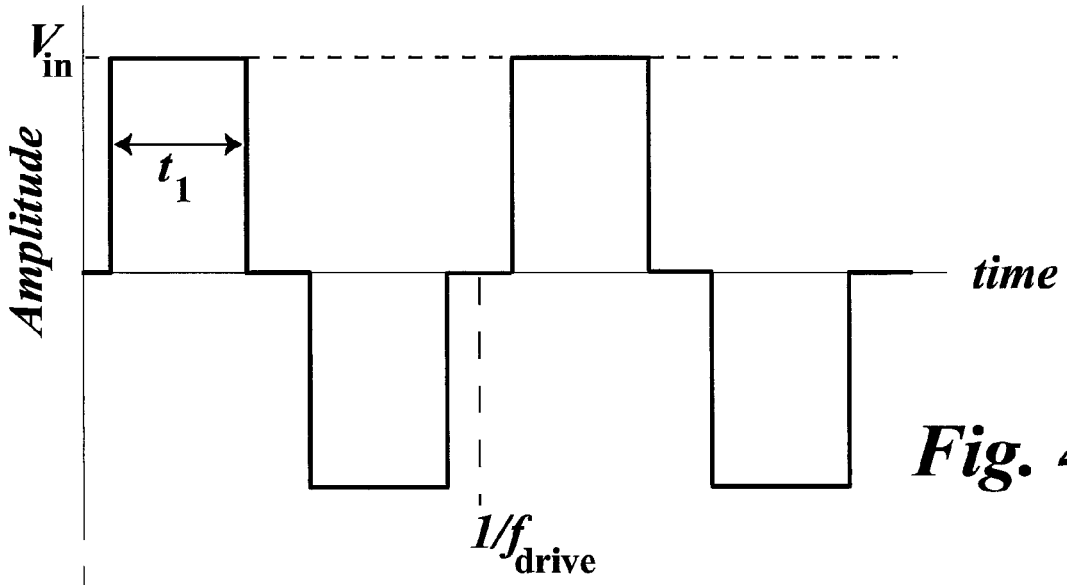
FIGS. 4*a* and 4*b* shows a diagrammatic representation of the pulse generator output.
Figure 4B:
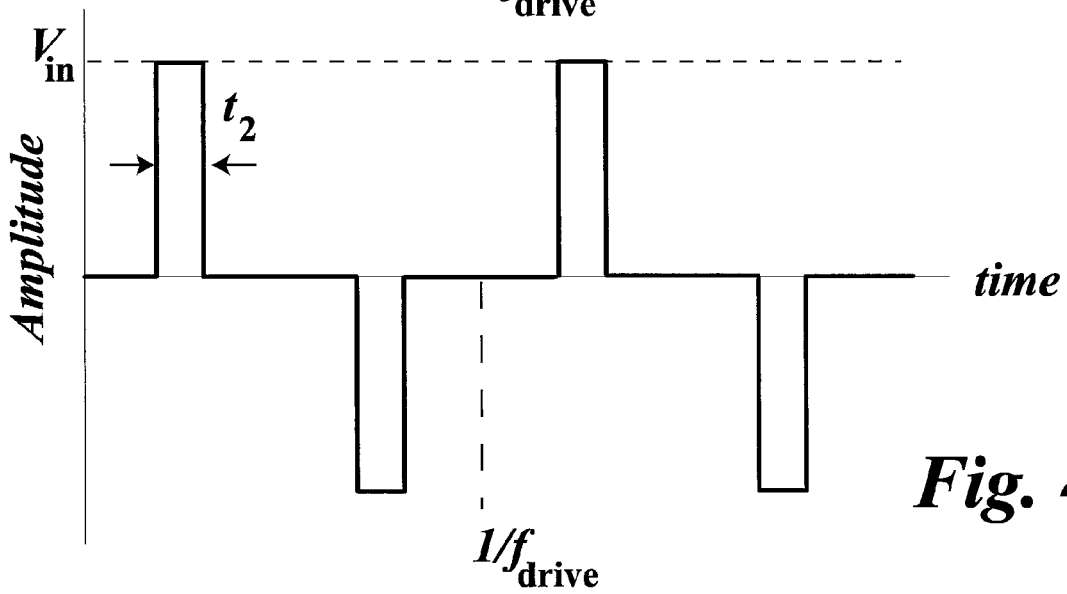

Referring to FIGS. 4*a* and 4*b*, another method of reducing the signal strength when over-stimulation of the RFID device is detected, is to maintain the value of $C_{effective}$ but reduce the duration t that each FET of the FET pair, Q1*a*, Q1*b* is on for, without changing the pulse generator circuit frequency $f_{drive}$, from $t_1$ to $t_2$. The amplitude of the output of each FET Q1*a*, Q1*b* remains unchanged. As the frequency is unchanged, the period between each FET output (when the value is $\frac{1}{2}V_{in}$) is increased. The smoothed signal is a sinusoidal wave form of the same frequency $f_{drive}$ as previously but having a reduced amplitude. This in turn reduces the amplitude of the aerial signal, overcoming the over-stimulation of the RFID device, and overload of the amplifiers in the demodulator.

The amplitude of the pulse generated by the FET pair, Q1*a*, Q1*b* is determined by $V_{in}$. The magnitude of $V_{in}$ may be controlled to vary the amplitude of the pulses generated by the FET pair, Q1*a*, Q1*b*. Reducing the magnitude of $V_{in}$ provides an alternative means of reducing the amplitude of the aerial signal. Also, as the power supply of the circuit is typically provided by a battery. As the battery runs down, the magnitude of $V_{in}$ may reduce.

Varying the pulse width and/or amplitude of the driving signal can affect the response of the resonance. Therefore, each frequency and pulse generator setting combination to be used is tested at each setting up stage to find the optimum $C_{effective}$ setting for that combination. This automatically compensates for changes in $V_{in}$ due to the aging of the battery.

For some RFID devices which are prone to the overloading and giving a partial response to the RFID reader's interrogation, it may be more efficient to simply use a lower aerial signal amplitude for that RFID devices frequency compared to the aerial amplitudes used for other frequencies used to detect other types of RFID device. This avoids the need to detect a partial response and lower the aerial signal amplitude. This may be conveniently performed by lowering $V_{in}$ for the particular frequency corresponding to susceptible RFID devices.

It should be noted that the embodiment of the invention has been described above purely by way of example and that many modifications and developments may be made thereto within the scope of the present invention. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of operation of a pet door system comprising a pet door, a controllable lock for locking and unlocking the door, a resonant circuit having an antenna, a drive circuit for driving the resonant circuit with a drive signal at a driving frequency so that the antenna can communicate with an RFID device carried by a pet and so that the RFID device can modulate a signal in the resonant circuit to carry data, and a demodulator for demodulating the modulated signal in the resonant circuit to produce a demodulated signal and for deriving the data from the demodulated signal, the method comprising the steps of:

performing a setting-up operation comprising the steps of:

varying a value of a setting parameter, being at least one of capacitance and inductance, of the resonant circuit and so varying the resonant frequency while driving the resonant circuit at a first driving frequency, detecting a first value of the setting parameter at which the resonant circuit is substantially in tune while the resonant circuit is driven at the first driving frequency, and storing the first value of the setting parameter; and subsequently performing a reading operation comprising the steps of:

reading the stored first value of the setting parameter, driving the resonant circuit at the first driving frequency with the capacitance and/or inductance of the controllable element set to the read first value of the setting parameter, and deriving data from the demodulator.

2. A method of claim 1, wherein:

the setting-up operation also includes the steps of:

varying the value of the setting parameter of the controllable element while driving the resonant circuit at a second driving frequency, detecting a second value of the setting parameter at which the resonant circuit is substantially in tune while the resonant circuit is driven at the second driving frequency, and storing the second value of the setting parameter.

3. A method of claim 2, wherein:

the reading operation, after a first phase of the aforementioned steps, further includes the steps, during a second phase of the reading operation, of:

reading the stored second value of the setting parameter, driving the resonant circuit at the second driving frequency with the setting parameter of the controllable element set to the read second value of the setting parameter, and deriving data from the demodulator.

4. A method of claim 3, further comprising the step of:

determining, from the data derived during such a first phase of the reading operation, whether to make such a change to such a second phase of the reading operation.

5. A method of claim 3, wherein:

the steps of deriving data during such a first phase and such a second phase of the reading operation are performed without interruption.

6. A method of claim 1, wherein:

the reading operation is repeated automatically; and such a setting up operation is not performed automatically between every successive pair of reading operations.

7. A method of claim 1, wherein the method further includes the steps of:

detecting proximity of a pet to the door; and in response to such detection, performing such a reading operation, but not such a setting-up operation.

8. A method of claim 1, wherein:

such a setting-up operation is performed in response to powering-up of the system.

9. A method of claim 1, wherein:

such a setting-up operation is performed at predetermined time intervals.

10. A method of claim 1, wherein there are included the steps of driving the resonant circuit at the first driving frequency, deriving data from the demodulator, detecting if the modulator is overloaded by the strength of the antenna signal, and reducing the antenna signal strength.

11. A method of claim 1, wherein the method further includes the steps of:

performing a registration operation in which such a reading operation is performed and at least some of the derived data is stored; and performing such a setting-up operation in conjunction with such a registration operation.

12. A method of claim 1, further including the step, during such a reading operation, of:

detecting the signal strength of the demodulated signal; and adjusting the value of the setting parameter of the controllable element and/or the driving frequency in dependence upon the monitored signal strength.

13. A method of claim 12, wherein:

the value of the setting parameter of the controllable element and/or the driving frequency is adjusted so as to maximize the detected signal strength.

14. A method of claim 12, wherein:

the value of the setting parameter of the controllable element and/or the driving frequency is adjusted so as to reduce the detected signal strength to a predetermined value.

15. A method of claim 1, wherein:

the resonant circuit includes:

an inductor, which forms the antenna, and a first capacitor permanently coupled into the resonant circuit, a second capacitor, and a switch for switchably coupling the second capacitor into the resonant circuit for a part of each cycle of the waveform of the drive signal, the switch and second capacitor forming the controllable element, and the part of each cycle being determined from the setting parameter.

16. A method of claim 1, wherein the setting up operation is performed without reading the RFID device.

* * * * *